US010397712B2

(12) United States Patent
Rosenkranz et al.

(10) Patent No.: US 10,397,712 B2
(45) Date of Patent: Aug. 27, 2019

(54) METHOD FOR FREQUENCY DISTORTION OF AN AUDIO SIGNAL, METHOD FOR SUPPRESSING AN ACOUSTIC FEEDBACK IN AN ACOUSTIC SYSTEM AND HEARING AID

(71) Applicant: SIVANTOS PTE. LTD., Singapore (SG)

(72) Inventors: Tobias Daniel Rosenkranz, Erlangen (DE); Tobias Wurzbacher, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/904,479

(22) Filed: Feb. 26, 2018

(65) Prior Publication Data

US 2018/0255407 A1 Sep. 6, 2018

(30) Foreign Application Priority Data

Mar. 6, 2017 (DE) ..... 10 2017 203 631

(51) Int. Cl.
*H04R 25/00* (2006.01)
*G10L 21/0272* (2013.01)
*H04R 27/00* (2006.01)

(52) U.S. Cl.
CPC ..... *H04R 25/505* (2013.01); *G10L 21/0272* (2013.01); *H04R 25/453* (2013.01); *H04R 27/00* (2013.01); *H04R 2430/03* (2013.01)

(58) Field of Classification Search
CPC ..... H04R 25/453; H04R 21/0272; H04R 2430/03; H04R 27/00
USPC ..... 381/318, 315, 324
See application file for complete search history.

(56) References Cited

U.S. PATENT DOCUMENTS

| | | | | |
|---|---|---|---|---|
| 8,411,885 | B2 | 4/2013 | Kornagel et al. | |
| 8,494,199 | B2 | 7/2013 | Kates | |
| 9,824,675 | B2 | 11/2017 | Rosenkranz et al. | |
| 10,225,667 | B2 | 3/2019 | Puder | |
| 2016/0057548 | A1 | 2/2016 | Wurzbacher et al. | |
| 2016/0260423 | A1* | 9/2016 | Rosenkranz | G10K 11/002 |
| 2017/0064464 | A1* | 3/2017 | Rosenkranz | H04R 25/305 |

FOREIGN PATENT DOCUMENTS

| | | | |
|---|---|---|---|
| DE | 102009018812 | A1 | 11/2010 |
| DE | 102015204010 | A1 | 9/2016 |
| EP | 2244491 | B2 | 9/2014 |

(Continued)

*Primary Examiner* — Melur Ramakrishnaiah
(74) *Attorney, Agent, or Firm* — Laurence A. Greenberg; Werner H. Stemer; Ralph E. Locher

(57) ABSTRACT

A method for the frequency distortion of an audio signal includes splitting the audio signal into a plurality of specified frequency bands, in which a band limit frequency is defined in each case by two respective immediately adjacent frequency bands. A first frequency band and a second frequency band lying immediately above the first frequency band are determined on the basis of the audio signal. A distortion of the frequencies differing from the distortion applied to signal components in the second frequency band is applied to signal components in the first frequency band, and a frequency-distorted signal is generated as a result. A method for suppressing an acoustic feedback in an acoustic system and a hearing aid are also provided.

13 Claims, 4 Drawing Sheets

(56) References Cited

FOREIGN PATENT DOCUMENTS

| | | | |
|---|---|---|---|
| JP | 2011223581 | A | 11/2011 |
| JP | 2014204213 | A | 10/2014 |
| JP | 2016171567 | A | 9/2016 |

* cited by examiner

METHOD FOR FREQUENCY DISTORTION OF AN AUDIO SIGNAL, METHOD FOR SUPPRESSING AN ACOUSTIC FEEDBACK IN AN ACOUSTIC SYSTEM AND HEARING AID

CROSS-REFERENCE TO RELATED APPLICATION

This application claims the benefit, under 35 U.S.C. § 119, of German Patent Application DE 10 2017 203 631.1, filed Mar. 6, 2017; the prior application is herewith incorporated by reference in its entirety.

BACKGROUND OF THE INVENTION

Field of the Invention

The invention relates to a method for the frequency distortion of an audio signal, in which a differing distortion of the frequencies is applied to different signal components of the audio signal and a frequency-distorted signal is generated as a result. The invention also relates to a method for suppressing an acoustic feedback in an acoustic system and a hearing aid.

The control of an acoustic feedback often plays a central role in the operation of acoustic systems which, in the broadest sense, reproduce sound signals of the environment in electrically amplified form, i.e., for example, for the operation of hearing aids as well. The acoustic feedback may occur in that case if an output sound signal generated by the acoustic system is partially injected into an input converter of the acoustic system which is provided to pick up the sound signal of the environment and correspondingly generate an electrical input signal. In that case, signal components of the output sound signal may again be electrically amplified by the acoustic system, so that interfering noise which may completely overlay possible useful signals in the sound signal of the environment to the point of those useful signals becoming inaudible, is formed as a result in the output sound signal. A suppression or compensation of an acoustic feedback is therefore often provided in the electrical signal path of the acoustic system. A compensation of that type is often implemented by using an adaptive filter to which the completely amplified output signal from which the output sound signal is generated is fed as an input variable. A compensation signal is generated therefrom and is fed to the still unamplified input signal to compensate for the feedback. The adaptive filter is usually controlled in that case through a fault signal which is formed from the difference between the input signal and the compensation signal.

In order to do that, the completely amplified output signal is often subjected to a frequency distortion in the acoustic system, as a result of which the output signal is decorrelated from the input signal so that an occurrence of the described signal loss can be largely avoided. The frequency distortion is usually applied in that case only to a specific frequency range of the amplified signal depending on the type of the sound signal of the environment, for which purpose the amplified signal is filtered at a given division frequency into a signal component which is to be distorted and a signal component which is not to be distorted.

In order to suppress the occurrence of artefacts in the output signal as much as possible, the division frequency is usually adapted to a determined acoustic feedback. The division frequency is normally implemented in that case through high-pass and low-pass filters which result in an additional latency in the acoustic system.

European Patent EP 2 244 491 B2, corresponding to U.S. Pat. No. 8,411,885, specifies a method for operating a hearing aid which provides for the splitting of an input signal into a high-frequency and a low-frequency signal component, wherein a frequency distortion is applied to the high-frequency signal component. A limit frequency for the splitting into the high-frequency and the low-frequency signal component is determined in that case by using an analysis of the input signal in such a way that artefacts in an output signal which is formed on the basis the low-frequency and the frequency-distorted high-frequency signal component are reduced as much as possible.

SUMMARY OF THE INVENTION

It is accordingly an object of the invention to provide a method for frequency distortion of an audio signal, a method for suppressing an acoustic feedback in an acoustic system and a hearing aid, which overcome the hereinafore-mentioned disadvantages of the heretofore-known methods and hearing aids of this general type and which are intended to minimize the latency as much as possible and thereby suppress the formation of artefacts as much as possible.

With the foregoing and other objects in view there is provided, in accordance with the invention, a method for the frequency distortion of an audio signal, wherein the audio signal is split into a plurality of specified frequency bands, a band limit frequency is defined in each case by two respective immediately adjacent frequency bands, a first frequency band and a second frequency band lying immediately above the first frequency band are determined (directly or indirectly) on the basis of the audio signal, and a distortion of the frequencies differing from the distortion applied to signal components in the second frequency band is applied to signal components in the first frequency band. A frequency-distorted signal is generated as a result (i.e. from the two differently frequency-distorted signal components).

In particular, the frequency-distorted signal occurs in the frequency domain.

In this case, an audio signal generally includes an electrical signal, the signal characteristic of which can serve as a carrier of acoustic information, and which can be converted by a suitable output converter into a corresponding sound signal. The audio signal is split in this case into a plurality of specified frequency bands, for example by using a filter bank. The individual frequency bands, in particular the band characteristics of the individual frequency bands, such as, for example, the respective mid-frequency and/or bandwidth, are specified in this case, for example, by a higher-level application in which the audio signal is used. The higher-level application includes, for example, a signal processing operation in a hearing aid. In this case, the individual frequencies are specified, in particular, on the basis of the requirements for the frequency-band-based signal processing in the hearing aid.

Two frequency bands are to be regarded as immediately adjacent particularly if no further characteristic frequency of a different frequency band lies between the two characteristic frequencies which in each case define the position of a frequency band in the frequency domain. In particular, a mid-frequency of a frequency band or a maximum frequency of the absolute frequency response is used as a characteristic frequency of this type. The band limit frequency of two immediately adjacent frequency bands is preferably to be defined in such a way that information relating to the filter behavior of each of the two frequency bands concerned is provided therefrom in the frequency range in which the two frequency bands concerned are adjacent, i.e. particularly in a possible overlap area. In particular, the band limit frequency is determined as the frequency for which the two immediately adjacent frequency bands have the same absolute frequency response, or as the arithmetic or geometric mean value between the characteristic frequencies determining the two immediately adjacent frequency bands.

According to the invention, a (first) target frequency indicating a desired limit between two frequency ranges with differing distortion is initially determined on the basis of the audio signal. The first and the second frequency band are then determined indirectly on the basis of this target frequency. Since the target frequency is derived from characteristics of the audio signal, this target frequency coincides exactly with a band limit frequency in exceptional cases only. It is normally more or less distanced from the nearest band limit frequency.

The first target frequency is determined, in particular, in the higher-level application of the audio signal, e.g. in the case of a signal processing operation in a hearing aid depending on a necessity arising in the hearing aid for frequency-distorted signals in a specific frequency range. In this connection, the first target frequency is preferably determined in such a way that it is particularly appropriate for the requirements for the desired frequency distortion of the audio signal by the higher-level application, so that, in particular, the first target frequency represents a critical value for the higher-level application of the audio signal in terms of the frequency distortion, with a change in the frequency distortion of the audio signal preferably taking place in a suitable manner at that critical value. In the case of a signal processing operation in a hearing aid as the higher-level application, such a critical frequency for the frequency distortion includes, for example, an acoustic feedback which is to be suppressed on the hearing aid, which is preferably being carried out in the smallest possible frequency range, wherein a frequency distortion is applied in the suppression of the acoustic feedback. The minimum frequency, for example, for which a suppression of an acoustic feedback is required in order to guarantee a total amplification of less than one in the closed loop formed from the acoustic feedback path and the signal processing is selected in this case as the critical frequency.

The first frequency band and the second frequency band lying immediately above the first frequency band are preferably determined on the basis of only the first target frequency, for example by selecting those immediately adjacent frequency bands having a band limit frequency which lies, in particular, immediately below the first target frequency, as the first frequency band and the second frequency band lying immediately above the first frequency band, i.e. in that no further band limit frequency of other frequency bands then lies, in particular, between the first target frequency and the underlying band limit frequency at which the first frequency band and the second frequency band are adjacent. In one alternative configuration of the invention, further parameters are also used in addition to the first target frequency. The respective signal components in the individual frequency bands, for example, are also taken into account, and only those frequency bands for the signal components of which a specified maximum level is not exceeded are therefore permitted as the first frequency band and the second frequency band. If the first target frequency is defined in this case in the higher-level application of the audio signal as a maximum critical frequency in terms of the frequency distortion, the signal levels are taken into account, for example, in such a way that two adjacent frequency bands are determined with a band limit frequency below the first target frequency, the signal components of which do not exceed the specified maximum level.

Further signal processing steps, e.g. a frequency-band-specific amplification of the signal components carried in the individual frequency bands, are performed between the splitting of the audio signal into the frequency bands and the frequency distortion described above. This means that the signal components in the first frequency band or in the second frequency band to which the differing distortion of frequencies is to be applied are not necessarily identical to the signal components of the audio signal in the splitting into the individual frequency bands. Additionally or alternatively, further signal processing steps of this type can also be carried out following the frequency distortion.

Preferably, the respective distortion of the frequencies does not remain restricted only to the signal components of the first frequency band or the second frequency band, but may also extend in each case to further frequency bands lying further away from the band limit frequency between the first frequency band and the second frequency band. This includes, in particular, the case where a specific distortion of frequencies is applied to signal components in all low frequency bands up to and including the first frequency band, and a distortion of the frequencies differing from the previous distortion is applied in each case to signal components of all high frequency bands from and including the second frequency band upwards. The "differing frequency distortion" of the signal components in the first or second frequency band (and, where appropriate, further respectively associated frequency bands) also includes, in particular, the case where the signal components in one of these two frequency bands (and, where appropriate, the associated further frequency bands) is not distorted, so that the output frequency of this frequency band or these frequency bands corresponds to the respective input frequency.

If an audio signal is to be distorted in a frequency-dependent manner, a splitting into individual frequency bands taking place in the higher-level application of the audio signal can therefore now be used for the aforementioned frequency distortion, so that the already available infrastructure of the higher-level application of the audio signal can be used for the implementation of the frequency dependency of the frequency distortion itself. On one hand, this has a resource-saving effect in the higher-level application, and, on the other hand, eliminates the need for an additional independent filter process for the splitting of the frequencies for the frequency distortion, whereby additional latencies are avoided.

According to the invention, the frequency band having an upper band limit frequency which is formed by the band limit frequency lying, in particular, immediately below the first target frequency is determined as the first frequency band. Most customary implementations of a splitting of an audio signal into a plurality of specified frequency bands are provided in such a way that the resulting frequency bands in each case have an absolute frequency response with a defined maximum and/or without local minima. For a given frequency band, the area, in particular, between the two band limit frequencies to the respective immediately adjacent frequency bands is indicated as the area of the frequency band in which the absolute frequency response normally has its maximum for structural reasons and/or the absolute frequency response is greater than beyond one of the band limit frequencies. This area is now identified, in particular, as the core area of the frequency band. As a result of the proposed determination of the first frequency band as the frequency band having an upper band limit frequency which is formed by the band limit frequency lying immediately below the first target frequency, the first target frequency lies in the core area of the second frequency band for the described configuration of the frequency bands.

If the first target frequency is determined in the higher-level application of the audio signal as a minimum frequency for which a specific type of frequency distortion is desired, it can advantageously be achieved according to the invention that this desired minimum characteristic of the first target frequency is taken into account in every case through the aforementioned selection and the associated placement of the first target frequency into the core area of the second frequency band through a corresponding frequency distortion of the second frequency band.

At a time following the determination of the first and second frequency band, a third frequency band differing therefrom is appropriately determined on the basis of the audio signal instead of the first frequency band. A distortion of the frequencies differing from the distortion applied to signal components in a frequency band immediately adjacent (in particular lying immediately above) the third frequency band is applied to signal components in this third frequency band.

In one appropriate configuration of the invention, a second target frequency is first determined instead of the first target frequency on the basis of the audio signal. The third frequency band is then determined indirectly on the basis of this target frequency. The second target frequency does not normally coincide with one of the band limit frequencies either, but is usually more or less distanced from the nearest band limit frequency.

The third frequency band (and, where appropriate, the second target frequency also) are determined in this case, in particular, through a continuous, periodic or event-controlled updating in the higher-level application for the audio signal. The distortion of frequencies of signal components in the third frequency band or the immediately adjacent frequency band is carried out, in particular, in a manner similar to the distortion of frequencies of signal components in the first or second frequency band described above. In other words, the limit between two frequency ranges differing in terms of the frequency distortion is shifted depending on the audio signal by switching frequency bands between different types of frequency distortion.

In particular, a distortion of the frequencies initially applied, as described above, in relation to the signal components in the first frequency band and in the second frequency band can be achieved in this case simply by shifting the area of application toward the third frequency band and the frequency band lying immediately above the third frequency band. The adaptation of the distortion of frequencies to the second target frequency which is to be allocated as described to a frequency band and therefore to a band limit frequency differing from the first target frequency allows a response to changed requirements for the frequency distortion of the audio signal in the higher-level application, i.e., for example, to changes in a feedback which is to be suppressed in the signal processing in a hearing aid.

A check is preferably carried out in this case to determine whether the second target frequency lies immediately above the upper limit frequency of a further frequency band which differs from the first frequency band, wherein, depending on this check, the further frequency band is determined as the third frequency band, and wherein a distortion of the frequencies differing from the distortion applied to the signal components of the frequency band lying immediately above the third frequency band is applied to the signal components in the third frequency band. As a result, the second target frequency is allocated to the third frequency band in such a way that the core area of the frequency band lying immediately above the third frequency band includes the second target frequency. This is particularly advantageous if the second target frequency is determined on the basis of the audio signal according to the requirements of the higher-level application as a minimum frequency for a desired frequency distortion. The placement of the second target frequency into the core area of the frequency band immediately above the third frequency band and the corresponding application of the desired frequency distortion at least to the aforementioned frequency band and, where appropriate, to further frequency bands above and excluding the third frequency band then takes account of this minimum characteristic of the second target frequency.

In one advantageous configuration of the invention, the distortion of frequencies is effected in each case through a shift by an amount that is constant throughout the frequency and/or by a frequency value modulated in a time-dependent manner. In particular, the frequency value modulated in a time-dependent manner is constant in this case throughout the frequency. A distortion of frequencies to be applied to the signal components of the first frequency band in a manner differing from the distortion applied to the signal components of the second frequency band is then achieved, in particular, through a difference in the constant amount. In particular, the amount of the frequency shift according to the invention can also be zero for the signal components of one of the two frequency bands, preferably the first frequency band, so that the frequencies concerned are effectively not shifted.

The frequency distortion is correlated in the frequency domain with a time-dependent phase modification of the frequency-distorted signal component. Specifically, the signal component carried in each case in the frequency bands concerned is multiplied, in particular, by a complex-valued index $e^{i\Delta t}$, whereby the frequency distortion is achieved. In this case, the variable $\Delta$ indicates the strength of the frequency distortion for the respective frequency band. The variable t denotes the time. If $\Delta$ is identical for a plurality of frequency bands, this equates to a constant frequency shift of these frequency bands. A change in the frequency distortion to be applied to the signal component in a frequency band is preferably always made in such a way that the phase of the frequency-distorted signal component in the frequency distortion does not jump (i.e. change abruptly) or jumps only to an extent understepping a limit value due to this change. In one particularly appropriate configuration of the invention, the change in the frequency distortion is made only in the event of a zero crossing or in a specified vicinity of a zero crossing of the phase modification correlated with the distortion. The frequency distortion is thus changed only if the aforementioned index $e^{i\Delta t}$ of the phase modification is located on or close to the real axis of the complex number plane (i.e. for $\Delta \cdot t$ $0.2\pi, 4\pi, \ldots$ and $e^{i\Delta t}=1$).

In this way, audible artefacts (e.g. "clicking noises") in the frequency-distorted signal are advantageously avoided when the frequency distortion is changed.

In particular, for a change in a distortion to be applied to the signal components in a frequency band, the phase modification of the signal components concerned is checked, wherein a change in the frequency distortion is permitted only at or in the vicinity of the zero crossing of the phase modification. A change in a distortion to be applied to the signal components in a frequency band in this case includes, in particular, a change which is such that, following an updating of the first target frequency toward a second target frequency for signal components of frequency bands having a core area in each case which lies at least partially between the first target frequency and the second target frequency, the distortion of frequencies that is to be applied changes.

In this case, the change may also be a complete activation or deactivation of the frequency distortion for one or more frequency bands. The deactivation of the frequency distortion is expressed numerically in that the index $e^{i\Delta t}$ representing the frequency distortion changes into a phase modification term having the value 1. This change would evidently result in audible artefacts if the index $e^{i\Delta t}$ has a value differing significantly from 1 at the time of the deactivation. In order to avoid artefacts of this type, the deactivation of the frequency distortion is permitted in the advantageous configuration of the invention only at times when the amount of the product term $\Delta \cdot t$ representing the phase modification understeps a specified limit value of e.g. $\pi/8$ or even $\pi/16$.

In a further advantageous configuration of the invention, the first frequency band is additionally filtered with a low-pass filter, and/or the second frequency band is additionally filtered with a high-pass filter. The respective filtering is carried out in this case in particular at the band limit frequency between the first frequency band and the second frequency band. As a result, the overlap between the first frequency band and the second frequency band can be reduced. For signal components from the area of the overlap between the first frequency band and the second frequency band, the respectively different distortion of frequencies of signal components of signal components of the first frequency band and of the second frequency band with a subsequent synthesis and inverse transformation of the frequency-distorted signal from the frequency domain into the time domain results in an overlay of two differently frequency-distorted contributions of the same signal component. This may result in audible artefacts and/or beats. As a result of a reduction in the overlap precisely in the area in which the signal components are exposed in each case to different frequency distortions of the individual frequency bands, duplicated contributions of this type with differing frequency distortion which originally come from the same signal component can then be substantially suppressed. The low-pass filter is preferably applied only to the first frequency band and/or the high-pass filter is applied only to the second frequency band. As a result, the additional latency which arises due to the low-pass filter and/or the high-pass filter can be restricted to a small frequency range.

The band limit frequency between the first frequency band and the second frequency band is preferably shifted in this case from the value specified by the splitting of the frequency bands toward the first target frequency by using the filter characteristic of the low-pass filter and/or by using the filter characteristic of the high-pass filter. For this purpose, the high-pass filter preferably has a greater edge steepness than the low-pass filter. Consequently, the area in which a desired frequency distortion is applied and which is achieved through the distortion of frequencies of signal components in individual frequency bands can be better adapted to a frequency shift desired or required in the higher-level application of the audio signal, as limited by the first target frequency, through the shift of the band limit frequency between the first frequency band and the second frequency band and the associated changed absolute frequency response of the frequency bands concerned.

The distortion of frequencies is advantageously applied only to signal components of frequency bands on one side of the band limit frequency between the first frequency band and the second frequency band. On one hand, this can be implemented in a particularly simple manner using signal-processing technology. On the other hand, in many applications, it is a matter of applying a frequency distortion to the smallest possible range of the audio signal, wherein, on the other hand, a minimum range for a frequency distortion of the audio signal is specified by applicable constraints. In this case, the distortion of frequencies is applied only to signal components of those frequency bands in which a frequency distortion is regarded as desired or necessary.

With the objects of the invention in view, there is also provided a method for suppressing an acoustic feedback in an acoustic system, wherein an input converter of the acoustic system generates an input signal from a sound signal of the environment, an intermediate signal is generated on the basis of the input signal and is fed to a signal processing unit with a filter bank for the frequency-band-based splitting of the intermediate signal, an output signal is generated from a frequency-distorted signal and is converted by an output converter of the acoustic system into an output sound signal, an acoustic feedback occurring due to an injection of the output sound signal into the input converter is suppressed in the acoustic system on the basis of the frequency-distorted signal, and the previously described method for frequency distortion according to the invention is applied to the intermediate signal, and the frequency-distorted signal is generated as a result. The acoustic system in this case includes, in particular, a hearing aid and systems for the recording, amplification and reproduction of sound signals from studio and/or stage technology.

An input converter generally includes an acousto-electrical converter which is configured to convert the sound signal of the environment into a corresponding electrical or electromagnetic signal, i.e., for example, a microphone. An output converter generally includes an electro-acoustic converter which is configured to generate an output sound signal from an electrical and/or electromagnetic signal, i.e., for example, a loudspeaker or a sound source for bone sound conduction. Signal processing is understood in this case to mean, in particular, a processing of the input signal or a signal derived from the input signal, i.e., in particular, a frequency-band-dependent amplification and/or noise suppression.

A generation of the intermediate signal on the basis of the input signal is understood in this case to mean, in particular, that the signal processing receives a signal directly dependent on the input signal, i.e., for example, the input signal which has been corrected by a compensation signal to compensate for an acoustic feedback. The method for frequency distortion can then be applied to the intermediate signal in particular in such a way that the intermediate signal is split at the filter bank of the signal processing unit into individual specified frequency bands and, following a frequency-band-dependent processing of the signal components in the individual frequency bands through the signal processing, the differing distortion of frequencies is applied to the further processed signal components in the first frequency band or in the second frequency band in order to generate the frequency-distorted signal in this way. The output signal is then generated therefrom, inter alia through the synthesis of the individual frequency band components. The suppression of the feedback can be achieved by using an adaptive filter on the basis of the frequency-distorted signal, i.e. in particular also by using the output signal as a reference variable of the adaptive filter, through a corresponding compensation signal.

The advantages indicated for the method for the frequency distortion of an audio signal and its developments can be transferred accordingly to the method for suppressing an acoustic feedback in an acoustic system.

With the objects of the invention in view, there is concomitantly provided a hearing aid, including an input converter for generating an input signal from a sound signal of the environment, a signal processing unit with a filter bank for splitting an audio signal derived from the input signal on the basis of the input signal and a control unit which is configured to carry out the previously described method for the distortion of an audio signal. The advantages indicated for the method and for its development can be transferred accordingly in this case to the hearing aid. In particular, the signal processing unit and filter bank are parts of the control unit. In this case, the audio signal is an intermediate signal in the control unit.

Other features which are considered as characteristic for the invention are set forth in the appended claims.

Although the invention is illustrated and described herein as embodied in a method for frequency distortion of an audio signal, a method for suppressing an acoustic feedback in an acoustic system and a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
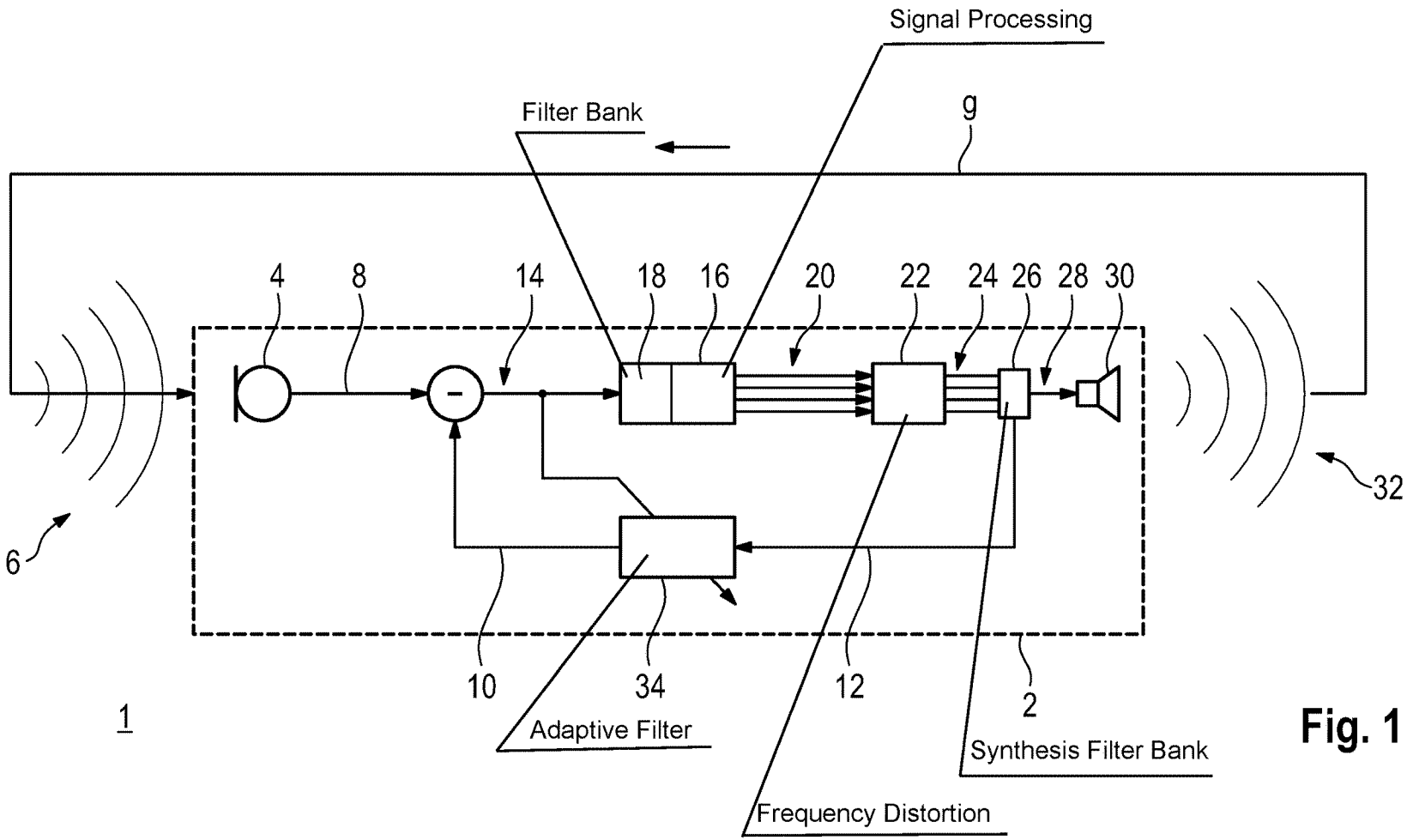
FIG. 1 is a schematic and block diagram of an acoustic system for performing a method for suppressing an acoustic feedback in a hearing aid.

Referring now in detail to the figures of the drawings in which matching parts and variables are denoted in each case with the same reference numbers, and first, particularly, to FIG. 1 thereof, there is seen a schematic and block diagram for carrying out a method 1 for suppressing an acoustic feedback g in an acoustic system. The acoustic system is provided in this case as a hearing aid 2. The hearing aid 2 includes an input converter 4 which generates an input signal 8 from a sound signal 6 of the environment and, in the present case, is provided as a microphone. A compensation signal 10, which is generated in an electrical feedback loop 12 in a manner still to be described, is subtracted from the input signal 8. An intermediate signal 14 resulting from the input signal 8 and the compensation signal 10 is fed to a signal processing unit 16 in which signal processing operations which are user-specific to the hearing aid 2 are performed (in particular a frequency-band-dependent amplification of the intermediate signal 14). For this purpose, the signal processing unit 16 includes a filter bank 18 on which the intermediate signal is split into individual frequency bands which are then processed accordingly in a user-specific manner. The signal processing unit 16 then outputs a processed signal 20 which is resolved in a frequency-band-based manner and to which a frequency distortion 22 is applied in a method still to be described. A frequency-distorted signal 24 in the time-frequency domain resulting from the frequency distortion 22 is then converted on a synthesis filter bank 26 into a broadband output signal 28 in the time domain which is converted in turn by an output converter 30 into an output sound signal 32. In the present case, the output converter 30 is provided as a loudspeaker.

On the other hand, the output signal 28 is branched off into the electrical feedback loop 12 and is fed there to an adaptive filter 34 which also receives the intermediate signal 14 as a further input variable as a fault signal, and generates the compensation 10 therefrom to suppress the acoustic feedback g. Due to the frequency distortion 22, the output signal 28 is decorrelated from the input signal 8 and therefore from the intermediate signal 14 also, so that, through the renewed input of the fault signal 14 into the adaptive filter 34, the latter is not fully adapted to the tonal signal components of the output signal 28. A formation of artefacts in the output signal 28 and therefore in the output sound signal 32 can thereby be avoided. The suppression of the acoustic feedback g by the compensation signal 10 can remain restricted, in particular to specific frequency ranges, i.e. in this case the compensation signal 10 has significant signal components for the aforementioned frequency bands only, in particular for those to which the frequency distortion 22 has been applied.

Figure 2:
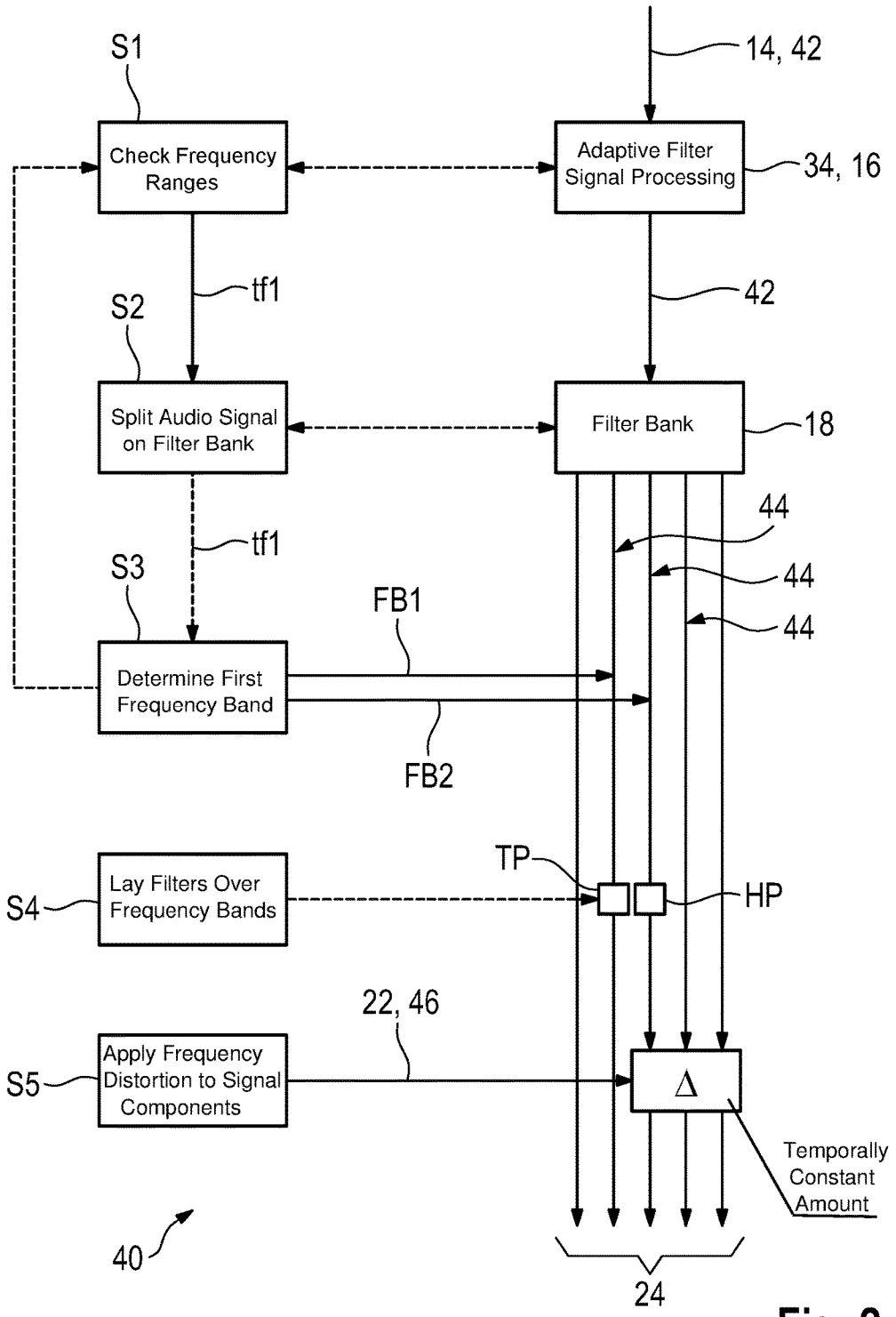
FIG. 2 is a schematic and block diagram showing a sequence of a method for the frequency distortion according to FIG. 1.

FIG. 2 shows in a schematic and block diagram the sequence of a method 40 for the frequency distortion 22 of the intermediate signal 14 according to FIG. 1. In this case, the intermediate signal 14 forms an audio signal 42 which acts as the input variable relevant to the method 40. In a first step S1, a check is carried out on the basis of the audio signal 42 to identify the frequency range in which an acoustic feedback g from the output converter 30 to the input converter 8 of the hearing aid 2 is to be suppressed, and the frequency range in which tonal signal components which may result in artefacts during the suppression of the feedback in the adaptive filter 34 are furthermore present in the audio signal 42. The check relating to the acoustic feedback g that is to be suppressed can be carried out by the adaptive filter 34, and relating to the tonality of the signal components preferably by the signal processing unit 16. A first target frequency tf1 is then defined depending on the results of these checks. The target frequency tf1 is determined in this case, in particular, as the minimum frequency above which a frequency distortion is required for an effective suppression of the acoustic feedback.

In the next step S2, the audio signal 42 is then split on a filter bank 18 into individual frequency bands. The step S2 may furthermore contain further substeps such as, for example, a frequency-band-dependent processing of signal components 44 in the generated frequency bands which do not, however, interfere with the sequence of the method 40 per se.

In a further step S3, a first frequency band FB1 is determined on the basis of the first target frequency tf1. In this case, the first frequency band FB1 is provided as the frequency band having an upper band limit frequency which is formed by the band limit frequency lying immediately below the first target frequency tf1, wherein the upper band limit frequency is provided as the frequency at which the absolute frequency response of the first frequency band is identical to the absolute frequency response of the frequency band immediately above the first frequency band FB1. The frequency immediately above the first frequency band FB1 is defined as a second frequency band FB2.

In the next step S4, a low-pass filter TP is then laid over the first frequency band FB1 at its band limit frequency to the second frequency band FB2, and a high-pass filter HP is then laid over the second frequency band FB2 at the same band limit frequency. As a result, on one hand, the overlap between the first frequency band FB1 and the second frequency band FB2 is reduced further than provided by the filter bank 18 while, on the other hand, due to the asymmetric configuration of the filter characteristics of the high-pass filter HP and the low-pass filter TP, the band limit frequency can be shifted slightly toward the first target frequency tf1.

In a step S5, the frequency distortion 22 is then applied to the signal components 44 in all frequency bands from the second frequency band FB2 upwards in the form of a frequency shift 46 by a temporally constant amount Δ, whereas the signal components 44 in all frequency bands from the first frequency band FB1 upwards remain unchanged, thereby generating the frequency-distorted signal 24.

The method 40 furthermore returns to step S1 with the specification of the first frequency band FB1, and updates the first target frequency continuously, periodically or in an event-based manner so that, in the event of a significant change in the acoustic feedback g, as a result of which the first target frequency tf1 lies outside the first frequency band FB1, a third frequency band FB3 is determined which takes the place of the first frequency band FB1 in order to continue the method 40 accordingly.

Figure 3:
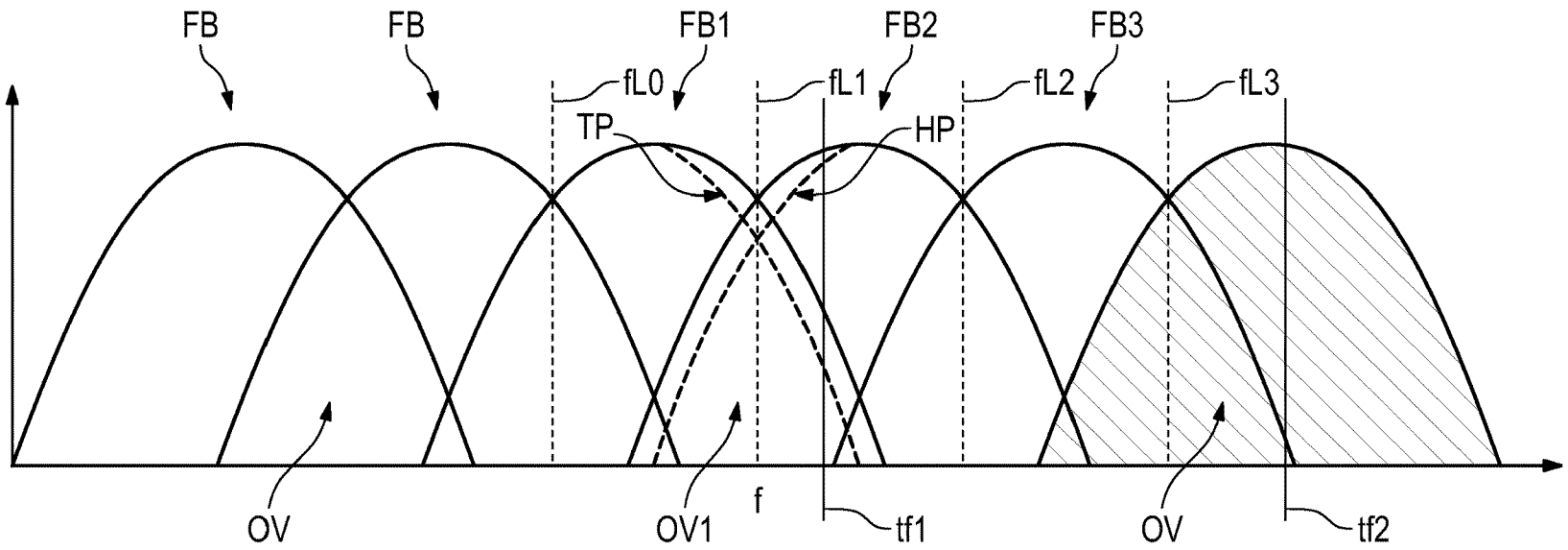
FIG. 3 is a diagram showing the frequency response of a filter bank in the method according to FIG. 2.

FIG. 3 shows the frequency response of a filter bank 18 in relation to a frequency f. The individual frequency bands FB have a significant overlap OV with the respectively adjacent frequency band, wherein two immediately adjacent frequency bands define a band limit frequency fL0 to fL3 which is provided as the frequency at which the absolute frequency response of the two adjacent frequency bands is equally great. According to step S1 of the method 40 according to FIG. 2, the first target frequency tf1 is then specified and the first frequency band FB1 is determined therewith as the frequency band having an upper band limit frequency fL1 which is formed by the band limit frequency lying immediately below the first target frequency tf1. As described above, a low-pass filter TP is laid over the first frequency band FB1 at the upper band limit frequency fL1, and a high-pass filter HP is laid over the second frequency band FB2 at the same band limit frequency fL1 which therefore limits the second frequency band FB2 downwards. As a result, the overlap OV1 between the first frequency band FB1 and the second frequency band FB2 can be reduced. Since the two aforementioned filters TP, HP are applied in each case to one frequency band only, any latency generated as a result is spectrally limited to the frequency bands concerned. In order to minimize the additional latency, only one complex-valued zero point (filter order 1) is inserted. The signal components of the audio signal 42 in the frequency bands above the upper band limit frequency fL1 of the first frequency band FB1, i.e. in the frequency bands from FB2 upwards, are then shifted by a constant amount.

If the acoustic feedback path which determines the acoustic feedback g in the hearing aid 2 according to FIG. 1 changes after a certain time, the first target frequency tf1 is updated accordingly to a second target frequency tf2 adapted to the change. A check is then carried out to determine whether the second target frequency tf2 still corresponds to the band limit frequency fL1 between the first frequency band FB1 and the second frequency band FB2, i.e. whether the band limit frequency fL1 also forms the band limit frequency lying immediately below the second target frequency tf2. If so, the frequency shift can continue to be applied unchanged to the signal components preferably of all frequency bands from the second frequency band FB2 upwards (hatched area).

In the present case, however, this does not apply, since the second target frequency now lies above the band limit frequency fL3 which limits a frequency band differing from the first frequency band upwards to the immediately adjacent frequency band. The frequency band limited from above by the band limit frequency fL3 is now defined as the third frequency band FB3, and the frequency shift is now carried out for signal components preferably of all frequency bands above and excluding the third frequency band FB3 in the manner already described, in particular using corresponding high-pass and low-pass filters at the band limit frequency (cross-hatched area).

Figure 4:
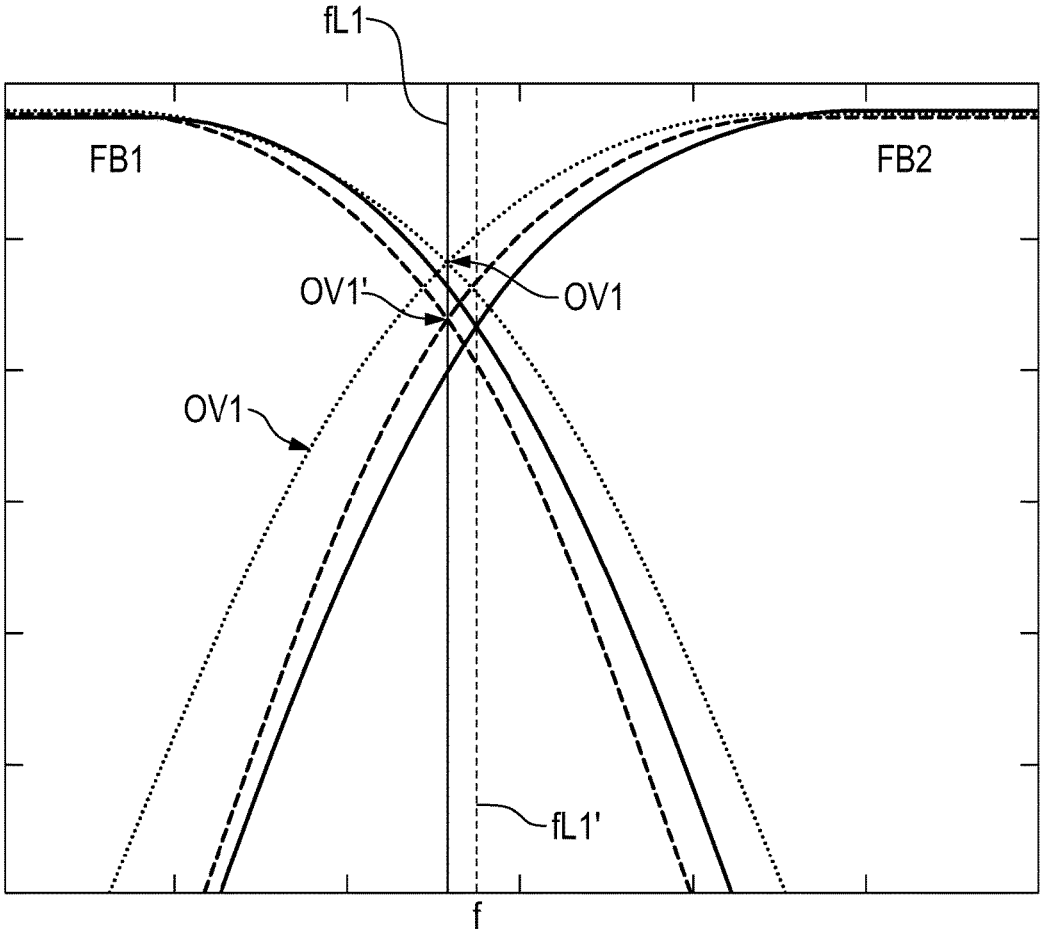
FIG. 4 is a diagram showing the frequency response of two adjacent frequency bands in the filter bank according to FIG. 3 adapted by high-pass and low-pass filters.

FIG. 4 shows the absolute frequency response of the first frequency band FB1 and of the second frequency band FB2 according to FIG. 3 at their band limit frequency fL1 relation to a frequency f. The dotted lines in each case show the absolute frequency response of the frequency bands FB1, FB2, as specified in the area of the band limit frequency fL1 by the higher-level filter bank. The overlap OV1 can be reduced in the area of the band limit frequency fL1 by using a low-pass filter or a high-pass filter applied to the first frequency band or the second frequency band (OV1', broken lines). If a low-pass filter and a high-pass filter with different, in particular asymmetric, filter characteristics are now used in this case, the band limit frequency fL1 can also be shifted slightly toward an adapted band limit frequency fL1', for example in the direction of the first target frequency, in addition to the reduced overlap OV1'.

Although the invention has been illustrated and described in detail by using the preferred exemplary embodiment, the invention is not restricted by this exemplary embodiment. Other variations can be derived therefrom by a person skilled in the art without departing from the protective scope of the invention.

The following is a summary list of reference numerals and the corresponding structure used in the above description of the invention:

1 Method for suppressing a feedback
2 Hearing aid
4 Input converter
6 Sound signal
8 Input signal
10 Compensation signal
12 Electrical feedback loop
14 Intermediate signal
16 Signal processing

18 Filter bank
20 Processed signal
22 Frequency distortion
24 Frequency-distorted signal
26 Synthesis filter bank
28 Output signal
30 Output converter
32 Output sound signal
34 Adaptive filters
40 Method for frequency distortion
42 Audio signal
44 Signal component
46 Frequency shift
FB Frequency band
FB1 First frequency band
FB2 Second frequency band
FB3 Third frequency band
fL0-fL3 Band limit frequency
fL1' Adapted band limit frequency
g Acoustic feedback
HP High-pass filter
OV Overlap
OV1 Overlap
OV1' Adapted overlap
S1-S5 Method step
TP Low-pass filter
ΔConstant frequency amount

The invention claimed is:

1. A method for the frequency distortion of an audio signal, the method comprising the following steps:

splitting the audio signal into a plurality of specified frequency bands and defining band limit frequencies by two respective immediately adjacent frequency bands;

initially determining a target frequency based on the audio signal for a limit between two frequency ranges with different distortion of the frequencies, and determining a first frequency band based on the target frequency;

determining a frequency band having an upper band limit frequency formed by the band limit frequency lying below the target frequency as the first frequency band;

determining a second frequency band lying immediately above the first frequency band based on the audio signal; and applying a distortion of the frequencies differing from the distortion applied to signal components in the second frequency band to signal components in the first frequency band and generating a resulting frequency-distorted signal.

2. The method according to claim 1, which further comprises determining the frequency band having an upper band limit frequency formed by the band limit frequency lying immediately below the target frequency as the first frequency band.

3. The method according to claim 1, which further comprises:

at a time following the determination of the first frequency band, determining a third frequency band differing from the first frequency band by using the audio signal; and applying a distortion of the frequencies differing from the distortion applied to signal components in a frequency band immediately adjacent the third frequency band to signal components in the third frequency band.

4. The method according to claim 3, which further comprises initially determining a second target frequency differing from the first target frequency based on the audio signal in order to determine the third frequency band, and determining the third frequency band based on the second target frequency.

5. The method according to claim 4, which further comprises:

performing a check to determine whether the second target frequency lies immediately above an upper band limit frequency of a further frequency band differing from the first frequency band;

determining the further frequency band as the third frequency band depending on the check; and applying a distortion of the frequencies differing from the distortion applied to the signal components of the frequency band lying immediately above the third frequency band to the signal components in the third frequency band.

6. The method according to claim 1, which further comprises providing the distortion of each of the frequencies as a shift by at least one of an amount being constant throughout the frequency or a frequency value modulated in a time-dependent manner.

7. The method according to claim 1, which further comprises always carrying out a change in the distortion of the frequencies to be applied to the signal component in a frequency band in such a way that a phase of the frequency-distorted signal component does not jump or jumps only to an extent understepping a limit value due to the change.

8. The method according to claim 1, which further comprises carrying out a change in the distortion of the frequencies to be applied to the signal component in a frequency band only in a zero crossing or in a specified vicinity of a zero crossing of a phase modification of the frequency-distorted signal component correlated with the distortion.

9. The method according to claim 1, which further comprises additionally filtering at least one of:

the first frequency band with a low-pass filter or the second frequency band with a high-pass filter.

10. The method according to claim 9, which further comprises shifting the band limit frequency between the first frequency band and the second frequency band from a value specified by the splitting of the frequency bands toward the first target frequency by using at least one of a filter characteristic of the low-pass filter or a filter characteristic of the high-pass filter.

11. The method according to claim 1, which further comprises applying the distortion of frequencies only to signal components of frequency bands on one side of the band limit frequency between the first frequency band and the second frequency band.

12. A method for suppressing an acoustic feedback in an acoustic system, the method comprising the following steps:

using an input converter of the acoustic system to generate an input signal from a sound signal of the environment;

generating an intermediate signal based on the input signal and feeding the intermediate signal to a signal processing unit with a filter bank for a frequency-band-based splitting of the intermediate signal;

generating an output signal from a frequency-distorted signal and converting the output signal into an output sound signal by using an output converter of the acoustic system;

suppressing an acoustic feedback occurring due to an injection of the output sound signal into the input converter in the acoustic system based on the frequency-distorted signal; and applying the method for the frequency distortion according to claim 1 to the intermediate signal to generate the frequency-distorted signal.

13. A hearing aid, comprising:

an input converter for generating an input signal from a sound signal of the environment;

a signal processing unit with a filter bank for splitting an audio signal derived from the input signal based on the input signal; and a control unit configured to carry out the method according to claim 1.

* * * * *